US008371665B2

(12) United States Patent
Herrera et al.

(10) Patent No.: US 8,371,665 B2
(45) Date of Patent: Feb. 12, 2013

(54) APPLIANCE INTEGRATED NOISE ATTENUATOR WITH KICK PANEL

(75) Inventors: Eric Herrera, Lincoln City, OR (US); Marvin Joseph Houser, South Elgin, IL (US); Mohamed Salah Atali, LaSalle (CA); Kendrick William Banks, Tillsonburg (CA); Joel T. Johnson, Ringwood, IL (US)

(73) Assignee: Freudenberg-NOK General Partnership, Plymouth, MI (US)

( * ) Notice: Subject to any disclaimer, the term of this patent is extended or adjusted under 35 U.S.C. 154(b) by 2033 days.

(21) Appl. No.: 11/127,836

(22) Filed: May 12, 2005

(65) Prior Publication Data

US 2006/0254854 A1 Nov. 16, 2006

(51) Int. Cl.
*A47B 77/06* (2006.01)

(52) U.S. Cl. ..... 312/228

(58) Field of Classification Search ..... 160/369, 160/371, 40, 41; 312/265.6, 228, 311, 278
See application file for complete search history.

(56) References Cited

U.S. PATENT DOCUMENTS

| | | | | |
|---|---|---|---|---|
| 3,985,198 | A | 10/1976 | Kurtze et al. | |
| 5,410,111 | A | 4/1995 | Stief et al. | |
| 5,473,125 | A | 12/1995 | Stief et al. | |
| 5,521,341 | A | 5/1996 | Stief et al. | |
| 5,589,242 | A | 12/1996 | Stief et al. | |
| 5,886,305 | A * | 3/1999 | Campbell et al. | 181/286 |
| 6,145,525 | A * | 11/2000 | Mooney | 135/119 |
| 6,158,703 | A * | 12/2000 | Kessler et al. | 248/240 |
| 2004/0129493 | A1 * | 7/2004 | Campbell | 181/204 |
| 2005/0218764 | A1 * | 10/2005 | Hong et al. | 312/401 |

* cited by examiner

*Primary Examiner* — James O Hansen
*Assistant Examiner* — Matthew Ing
(74) *Attorney, Agent, or Firm* — Daniel J. Sepanik, Esq.; Harness, Dickey & Pierce, P.L.C

(57) ABSTRACT

An integrated noise attenuator and kick panel are provided for attenuating noise emanating from an appliance such as a dishwasher, washer, dryer, or refrigerator. The kick panel includes an elongated panel member having side flaps which are biased laterally against cabinets or other structures disposed on each side of the appliance. The elongated panel member is also provided with a textured noise attenuating surface on the back thereof which, along with the side flaps, attenuates and absorbs the sound and vibration emanating from the appliance.

17 Claims, 3 Drawing Sheets

APPLIANCE INTEGRATED NOISE ATTENUATOR WITH KICK PANEL

FIELD OF THE INVENTION

The present invention relates to noise attenuation for appliances, and more particularly, to an integrated noise attenuator and kick panel for use with an appliance.

BACKGROUND AND SUMMARY OF THE INVENTION

Appliances such as dishwashers, washing machines, driers, and refrigerators have been used in homes for many years. Significant advancement at improving the efficiency of these appliances has been made over the years. Furthermore, additional enhancements at reducing the noise emitted from the appliances have also been made. However, it is still desirable to further improve the noise attenuation and sound quality of household appliances.

Accordingly, the present invention provides a flexible panel with a textured noise attenuating surface and made from an elastomeric or thermoplastic elastomer construction including a pair of flexible side flaps extending from opposite ends of the panel with the side flaps being adapted to extend laterally outward to engage a cabinet, enclosure, or other structure next to the appliance. The flexible panel may be attached or molded onto an elongated panel or rigid substructure to be mounted to cover a specified area of an appliance in such a way to provide attenuation/absorption of noise and/or vibration emitted by the appliance.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiment(s) is merely exemplary in nature and is in no way intended to limit the invention, its application, or uses.

Figure 1:
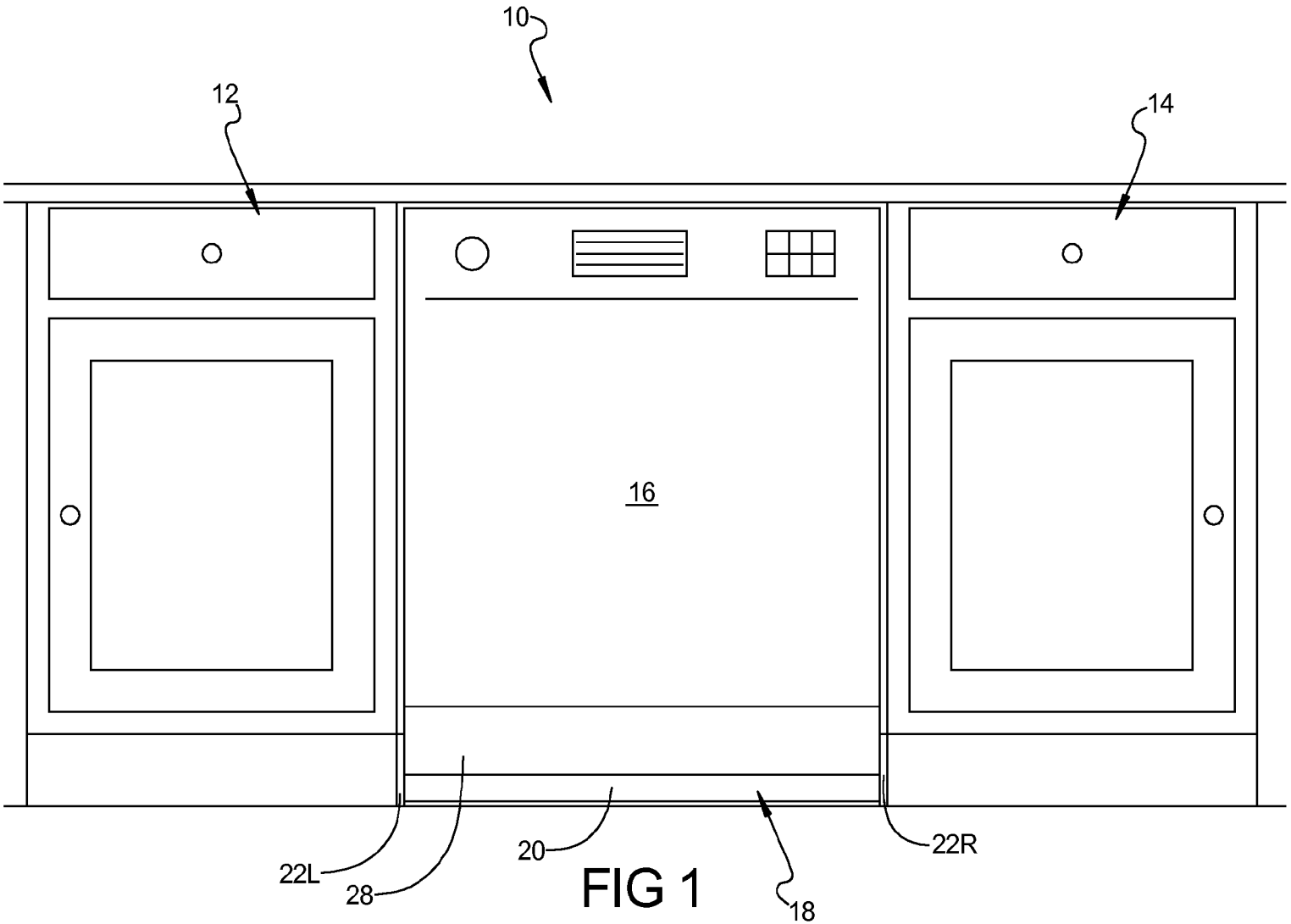
FIG. 1 is a front plan view of an exemplary appliance incorporating the noise attenuator panel according to the principles of the present invention.

FIG. 1 shows a front view of an exemplary appliance such as a dishwasher 10 installed in a typical environment disposed between two cabinets 12, 14 or other enclosure or structure on each side thereof. The dishwasher 10 includes a door 16 pivotally mounted to the dishwasher housing. An integrated noise attenuator and kick panel 18 is mounted below the door 16 and is securely fastened to the dishwasher housing. Although the noise attenuator panel 18 is described in combination with a dishwasher, it should be understood that the noise attenuator panel can be utilized on other appliances in order to attenuate noise and absorb vibrations.

Figure 2:
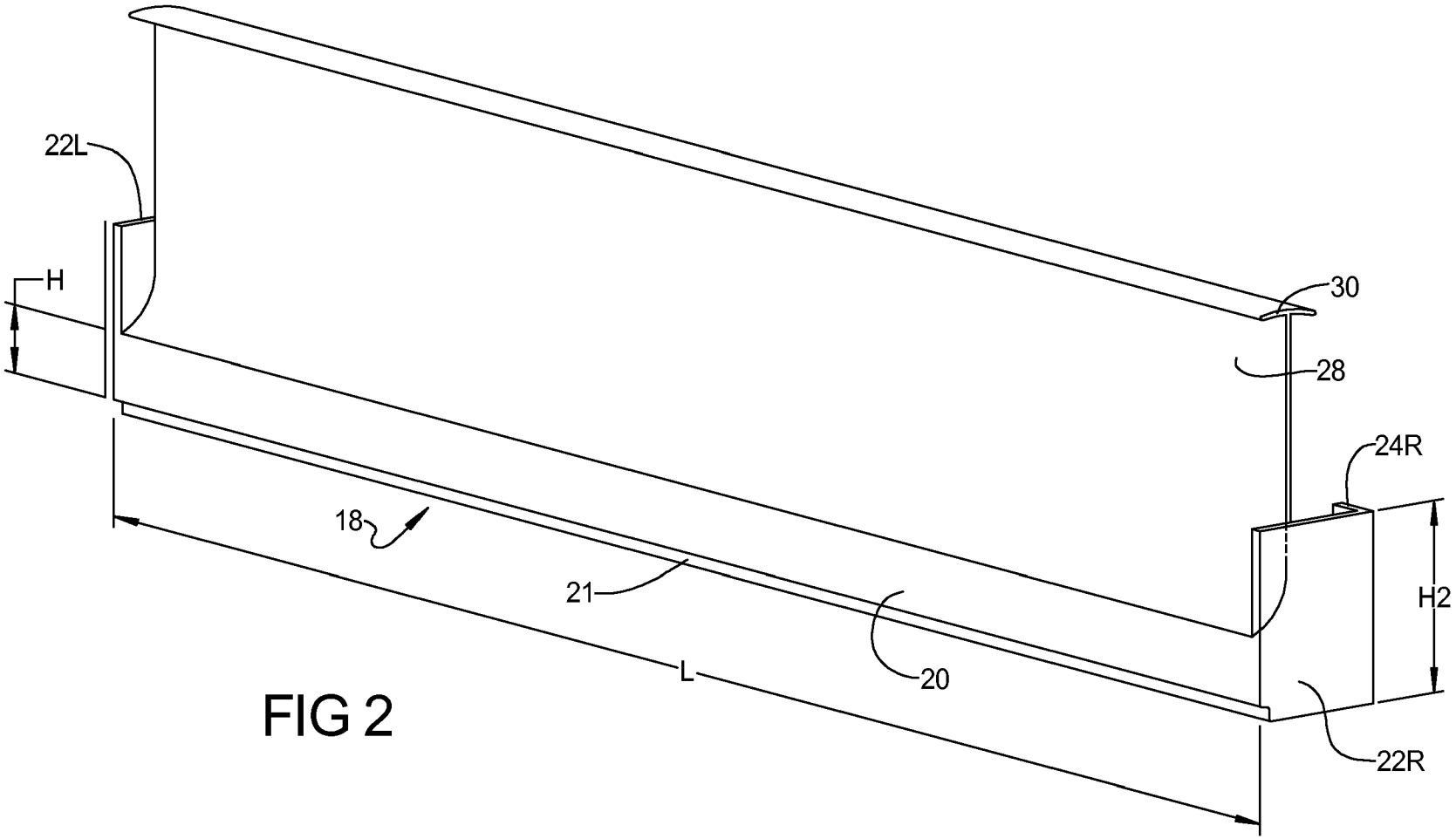
FIG. 2 is a perspective view of the noise attenuator panel according to the principles of the present invention.
Figure 3:
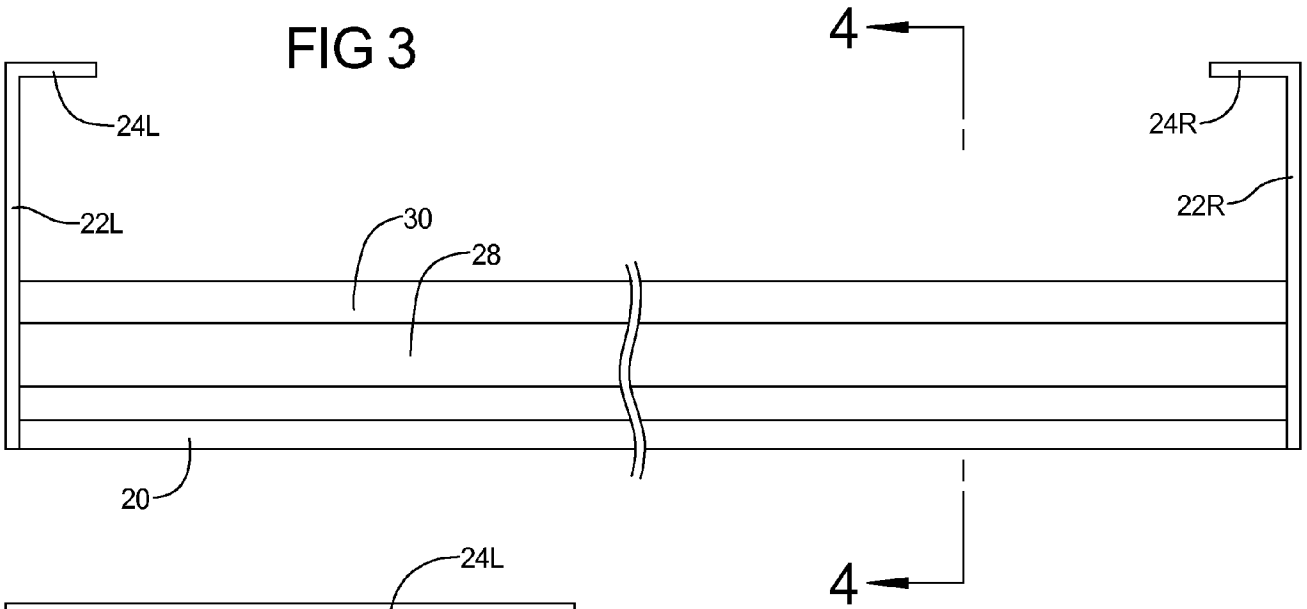
FIG. 3 is a bottom plan view of the noise attenuator panel according to the principles of the present invention.
Figure 4:
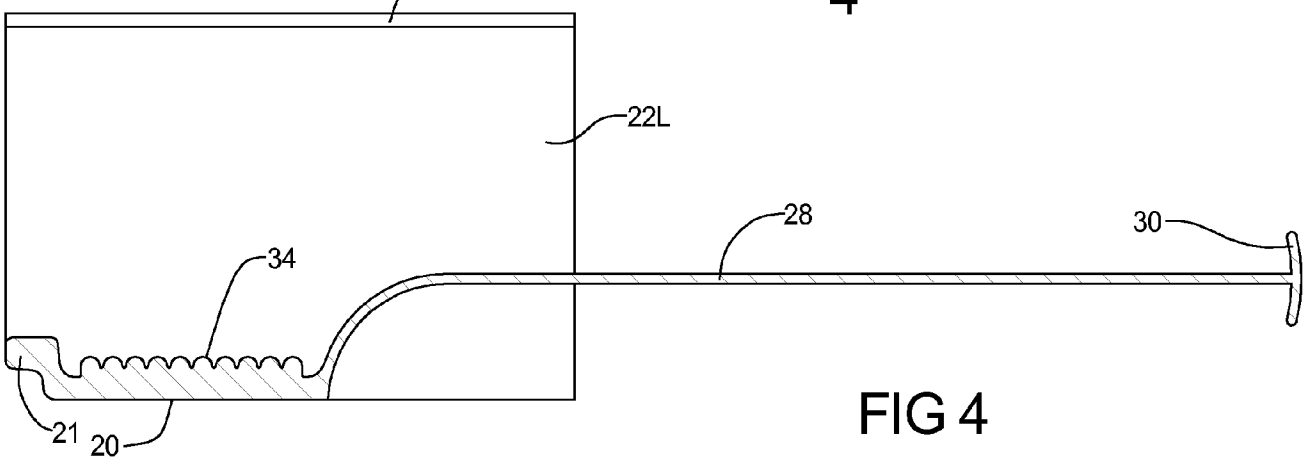
FIG. 4 is a cross-sectional view taken along line 4-4 of FIG. 3.

With reference to FIGS. 2-4, the integrated noise attenuator and kick panel 18 will now be described in greater detail. The integrated noise attenuator and kick panel 18 includes an elongated panel member 20 having a width approximately equal to the width of the housing of the dishwasher. The panel member 20 can be attached or molded to a rigid sub structure and/or panel to be mounted to cover a specified area of an appliance. The elongated panel member 20 preferably includes noise attenuating ribs, dimples, or other textured surface 34 on the backside thereof. A seal portion 21 is disposed along a bottom of the panel member 20 for sealing against the floor. The seal portion 21 can be a hollow-bulb-type structure or any other configuration capable of providing a seal contact with the floor. A pair of flexible side flaps 22L, 22R extend from opposite ends of the elongated panel 20. The elongated panel 20 has a length L and a height H. The side flaps 22L, 22R each preferably have a height H2 greater than the height H of the panel member 20. The side flaps 22L, 22R each extend angularly relative to the panel member 20 as illustrated in FIG. 3. The side flaps 22L, 22R are disposed at an angle a of approximately 90 degrees relative to the panel member 20, although other angles can be utilized. The side flaps 22L, 22R each include a perpendicular flap portion 24L, 24R extending from the distal rear ends of the side flaps 22L, 22R. The kick panel 18 includes a flexible apron portion 28 extending upward from the elongated panel member 20. The apron 28 includes a retaining portion such as a barb 30 extending along an upper edge thereof. The retaining portion 30 is adapted to be connected to the door 16 of the appliance 10 and can be fastened to the door by other known methods such as by an enlarged bead portion, fasteners, or adhesives.

In the assembled condition, the elongated panel member 20 is mounted to the front of the appliance housing along a bottom portion thereof. The noise attenuator kick panel 18 can be assembled using existing brackets or can be adhered, or otherwise held in place by known mounting techniques. The flexible apron 28 is connected to the door 16 and the side flaps 22L, 22R extend rearward from the front panel member 20 between the appliance housing and adjacent cabinets 12, 14. The rearward flaps 24R, 24L press against the appliance housing and force the flaps 22L, 22R in a lateral direction against the cabinets 12, 14, respectively (in the area of the recessed mop boards disposed under the cabinets). Accordingly, the side flaps 22L, 22R block airborne noise and vibrations from emanating between the appliance and cabinets 12, 14 or other adjacent structure. The apron 28 also provides a sound and vibration barrier for preventing sound and vibration from the motorized drive mechanism, compressors, and pump of the appliance from emanating outward therefrom. Furthermore, the sound attenuating/absorbing textured surface 34 on the back side of the elongated panel member 20 also helps to reduce the sound and vibrations emanating from the appliance. In addition, with the self-biasing structure of the rear flaps 24L, 24R biasing the side flaps 22L, 22R in the lateral direction upon assembly between the cabinets, the noise and vibration attenuating system of the present invention is easily assembled.

Acoustic testing conducted with a prototype sound attenuating kick panel, according to the principles of the present invention, have proven to reduce structure borne noise and vibration while absorbing high frequency noise to provide an overall reduction in noise of 2 dB or greater between the 100-20,000 Hz frequency range.

Furthermore, the integrated noise/vibration attenuator kick panel according to the principles of the present invention can also be integrally formed of any combination of elastomer, thermoplastic, and/or thermoplastic elastomer material which provide some form of structure for attachment purposes as well as flexibility for installation, and proper physical properties to provide sound attenuation/absorption thereby reducing noise and/or vibration and improving the overall sound quality of the appliance.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A kick panel for an appliance, comprising:

an elongated panel member adapted to be mounted to a front surface of an appliance; and at least one flexible side flap extending from an end of said elongated panel member, said flexible side flap being adapted to flex outward to engage a structure next to the appliance;

wherein said at least one flexible side flap extends angularly from said elongated panel member.

2. A kick panel for an appliance, comprising:

an elongated panel member adapted to be mounted to a front surface of an appliance;

at least one flexible side flap extending from an end of said elongated panel member, said flexible side flap being adapted to flex outward to engage a structure next to the appliance; and a flexible apron portion extending from a top portion of said elongated panel member and adapted to be mounted to a door of said appliance.

3. The kick panel according to claim 2, wherein said at least one side flap extends vertically above said top portion of said elongated panel member.

4. The kick panel according to claim 2, wherein said apron portion includes a retaining portion extending along an upper edge thereof.

5. The kick panel according to claim 4, wherein said retaining portion includes a barb portion having a diameter greater than a thickness of said apron portion.

6. The kick panel according to claim 4, wherein said retaining portion includes a retaining barb.

7. A kick panel for an appliance, comprising:

an elongated panel member adapted to be mounted to a front surface of an appliance;

a flexible apron portion extending from a top portion of said elongated panel member and adapted to be mounted to a door of said appliance.

8. The kick panel according to claim 7, wherein said apron portion includes a retaining portion extending along an upper edge thereof.

9. The kick panel according to claim 8, wherein said retaining portion includes a barb portion having a diameter greater than a thickness of said apron portion.

10. The kick panel according to claim 7, wherein said retaining portion includes a retaining barb.

11. An appliance, comprising:

a housing; and a kick panel including an elongated panel member adapted to be mounted to a front surface of said housing, and at least one flexible side flap extending from an end of said elongated panel member, said flexible side flap being adapted to flex laterally outward from said housing.

12. The appliance according to claim 11, wherein said at least one flexible side flap includes a pair of flexible side flaps extending from opposite ends of said elongated panel member.

13. The appliance according to claim 11, wherein said flexible side flap extends generally rearward relative to a front face of said elongated panel member.

14. The appliance according to claim 11, wherein said at least one flexible side flap extends angularly from said elongated panel member.

15. The appliance according to claim 11, wherein said flexible side flap includes a rear flap extending angularly from a rearward end thereof.

16. An appliance, comprising:

a housing;

a door pivotally attached to said housing; and a kick panel including an elongated panel member adapted to be mounted to a front surface of said housing, and a flexible apron portion extending from a top portion of said elongated panel member and mounted to said door.

17. The appliance according to claim 16, wherein said apron portion includes a retaining portion extending along an upper edge thereof and attached to said door.

* * * * *